US005544766A

United States Patent [19]

Dunn et al.

[11] Patent Number: 5,544,766

[45] Date of Patent: Aug. 13, 1996

[54] CODED TWO PART NIPPLE MEMBERS FOR BABY BOTTLES AND METHOD OF MAKING

[75] Inventors: Steven B. Dunn, Beverly Hills; Fernando Suarez, Costa Mesa, both of Calif.

[73] Assignee: Munchkin Bottling Inc., Van Nuys, Calif.

[21] Appl. No.: 334,206

[22] Filed: Nov. 4, 1994

[51] Int. Cl.[6] ..... A61J 11/00

[52] U.S. Cl. ..... 215/11.1; 206/459.5; 264/255

[58] Field of Search ..... 215/11.1, 11.3; 206/459.5; 606/234, 235, 236; 264/255, 328.7

[56] References Cited

U.S. PATENT DOCUMENTS

| | | | |
|---|---|---|---|
| 3,139,064 | 6/1964 | Harle | 215/11.1 X |
| 4,619,271 | 10/1986 | Burger et al. | 128/736 |
| 4,676,386 | 6/1987 | Phlaphongphanich | 215/11.1 |
| 4,688,571 | 8/1987 | Tesler | 606/234 |
| 4,700,856 | 10/1987 | Campbell et al. | 215/11.3 |
| 4,759,139 | 7/1988 | Ricks | 215/11.1 X |
| 4,832,214 | 5/1989 | Schrader et al. | 215/11.1 |
| 4,941,573 | 7/1990 | Fuerstman | 206/459.5 |
| 4,993,568 | 2/1991 | Morifuji et al. | 215/11.1 |
| 5,013,321 | 5/1991 | MacVane | 426/115 X |
| 5,069,351 | 12/1991 | Gunderson et al. | 215/11.1 |
| 5,114,374 | 5/1992 | Estiva | 447/77 |
| 5,117,994 | 6/1992 | Leblanc et al. | 215/11.1 |
| 5,207,338 | 5/1993 | Sandhu | 215/11.1 |
| 5,251,751 | 10/1993 | Prussen | 206/459.5 |
| 5,322,031 | 6/1994 | Lerner et al. | 116/208 |

FOREIGN PATENT DOCUMENTS

| | | |
|---|---|---|
| 1791260 | 7/1968 | Germany . |
| 2355545 | 7/1973 | Germany . |
| 59756 | 12/1911 | Switzerland . |

*Primary Examiner*—Allan N. Shoap
*Assistant Examiner*—Christopher J. McDonald
*Attorney, Agent, or Firm*—Woodcock Washburn Kurtz Mackiewicz & Norris

[57] ABSTRACT

An improved nipple member for an infant nursing system includes a nursing portion that is formed of a first material and a mounting flange portion that is formed of a second material. The nursing portion is preferably transparent, while the mounting flange portion is color coded to indicate a design flowrate or a type of beverage that the nipple member is designed to dispense. The first material is preferably harder than the second material, which makes the nipple member harder to pull out of an infant nursing system during use. A method of making a nipple member is also disclosed.

22 Claims, 4 Drawing Sheets

CODED TWO PART NIPPLE MEMBERS FOR BABY BOTTLES AND METHOD OF MAKING

BACKGROUND OF THE INVENTION

1. Field of the Invention

This invention relates to nursing systems for feeding liquids to infants and small children. More specifically, this invention relates to an integral molded nipple member for a nursing system that may be coded to indicate a flow rate or nipple type to a caregiver, and that may be selectively fabricated of materials having different characteristics throughout to improve performance and safety.

2. Description of the Prior Art

Nipple members for baby bottles typically have a circular mounting flange portion and a nursing portion that is designed to fit in an infant's mouth. The two portions are formed together in a single, unitary piece and are fabricated from the same type and grade of flexible material, usually latex, vinyl, silicone or thermoplastic elastomers (TPE's). Most silicone nipple members are transparent, which makes it easy for a caregiver to determine whether or not a nipple member is clean, and to determine whether an infant is drawing liquid or air out of the bottle. Latex nipples are opaque, and tend to be less expensive.

Nipple member types having different design flow rates and hole configurations for dispensing different types of liquids are widely available. As an infant grows, she or he will learn and expect to drink faster, and manufacturers of nipple members sell different types of nipple members to accommodate this. Different nipple member types tend to end up mixed in a single container, and a caregiver will have to search each time for the desired type of nipple member, frequently (as any caregiver who has given a midnight feeding will attest) in dim light. Some identifying legend is usually embossed on the rim, but it can be very difficult to read. Some cross-cut nipples, designed for juice or other pulpy beverages, are colored orange, which makes them easier to identify.

Most baby bottles are configured so that a ring member having a large hole therein screws on to the baby bottle to seat the mounting flange of the nipple member against the upper lip of the bottle. One disadvantage of this configuration is that, during use, an infant may be able to work the mounting flange radially from one side to another and pull the entire nipple member out through the hole in the ring. This can present a choking hazard, in addition to spilling the contents of the bottle.

There has existed a long and unfilled need in this area of technology for an improved nipple member that is easier to identify by type, even in dim light, and that is less likely to pull out of an infant nursing system during use.

SUMMARY OF THE INVENTION

Accordingly, it is an object of the invention to provided an improved nipple member that is easier to identify by type, even in dim light, then conventional nipple members.

It is further an object of the invention to provided an improved nipple member that is less likely to pull out of an infant nursing system during use then nipple members heretofore known.

In order to achieve the above and other objects of the invention, a nipple member for an infant nursing system includes, according to a first aspect of the invention, a mounting flange portion, the mounting flange portion being non-transparent; and a nursing portion, the nursing portion being substantially clear and transparent, whereby a caregiver can readily ascertain that the nursing portion is clean before feeding an infant.

A nipple member for an infant nursing system includes, according to a second aspect of the invention, a mounting flange portion, the mounting flange portion having at least an area thereon that is color coded to indicate a type of the nipple member; and a nursing portion, the nursing portion being substantially transparent, whereby a caregiver can readily ascertain that the nursing portion is clean before feeding an infant.

According to a third aspect of the invention, a nipple member for an infant nursing system includes, a nursing portion, the nursing portion having a first material; and a mounting flange portion, unitary with the nursing portion, the mounting flange portion including a second material that is harder than the first material, whereby the nipple member is more difficult to pull out from a nursing system during nursing than was heretofore possible.

According to a fourth aspect of the invention, an improved kit for bottle feeding infants and young children, includes (a) two or more of the following: (i) a first nipple member having a first design flow rate, the first nipple member including a first mounting flange portion and a first nursing portion, the first mounting flange portion having an area thereon that is color coded with a first color; (ii) a second nipple member having a second design flow rate that is greater than the first design flow rate, the second nipple member including a second mounting flange portion and a second nursing portion, the second mounting flange portion having an area thereon that is color coded with a second color; (iii) a third nipple member having a third design flow rate that is greater than the second design flow rate, the third nipple member including a third mounting flange portion and a third nursing portion, the third mounting flange portion having an area thereon that is color coded with a third color; and (iv) a juice-type nipple member having a fourth mounting flange portion and a fourth nursing portion having a cross-cut defined therein for juice or other beverages having solids suspended therein, the second mounting flange portion having an area thereon that is color coded with a fourth color; and (b) a package for holding the nipple members, whereby a caregiver may purchase a variety of nipple members for different purposes that can readily be distinguished from each other prior to use.

According to a fifth aspect of the invention, a method of making an improved nipple member for an infant nursing system, includes steps of: (a) molding a mounting flange portion from a first material that is colored; and (b) molding a nursing portion unitarily with the mounting flange portion out of a second material that is substantially clear and transparent, whereby a color-coded nipple member is produced that has a clean-appearing nursing portion.

A method of making an improved nipple member for an infant nursing system, according to a sixth aspect of the invention includes steps of: (a) molding a nursing portion out of a first material; and (b) molding a mounting flange portion unitarily with the nursing portion out of a second material that is harder than the first material, whereby a nipple member is formed that is more difficult to pull out of a nursing system during use than nipple members heretofore known were.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
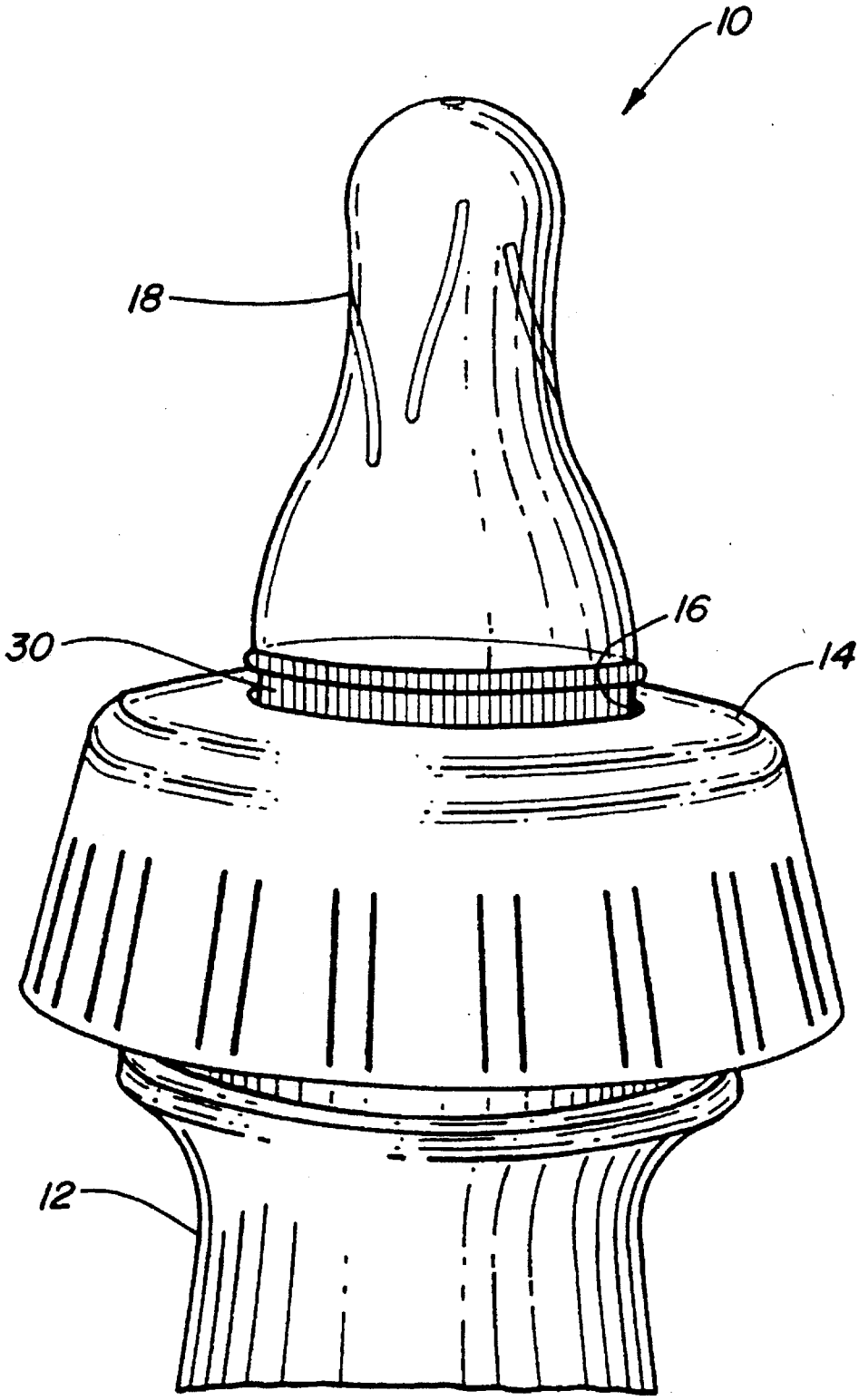
FIG. 1 is a fragmentary perspective view of an infant nursing system that is constructed according to an preferred embodiment of the invention.

Referring now to the drawings, wherein like reference numerals designate corresponding structure throughout the views, and referring first to FIG. 1, an infant nursing system 10 that is constructed according to a preferred embodiment of the invention includes a baby bottle 12 that has a ring 14 screwed thereon, in conventional fashion. Ring 14 has a central hole 16 defined therein through which a nipple member 18 that is constructed according to a preferred embodiment of the invention extends therethrough, as may be seen in FIG. 1.

Figure 2:
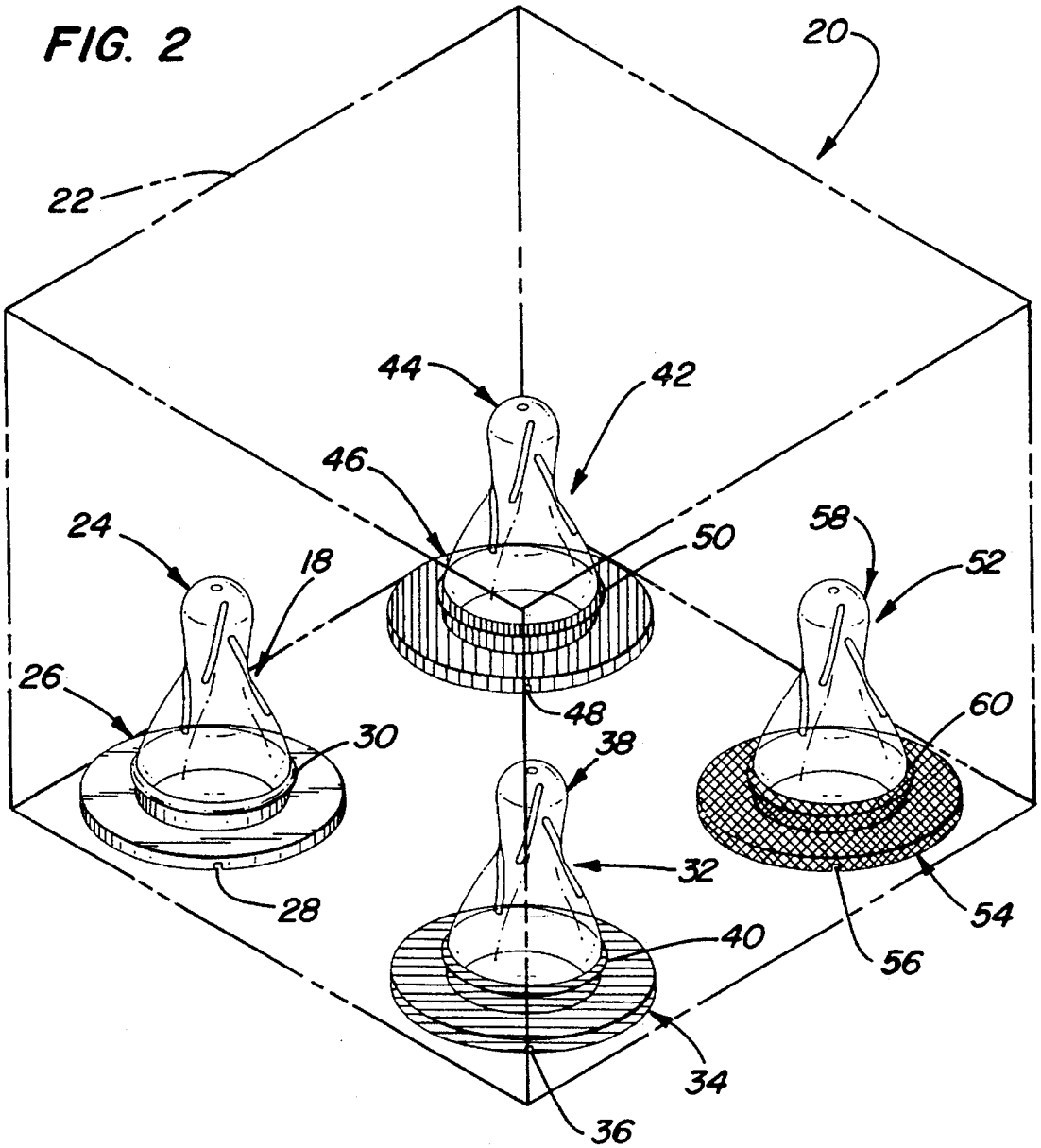
FIG. 2 is a diagrammatical depiction of a kit that is constructed according to a first preferred embodiment of the invention, with several exemplary nipple members depicted therein in perspective view.

Turning now to FIG. 2, a kit 20 for bottle feeding infants and children includes, according to a first preferred embodiment, a package 22 and a slow flow nipple member 18 that has a designed flow rate for infants between the ages of 0–3 months. To enable the desired flow rate, slow flow nipple member 18 has an orifice defined therein that has a diameter that is preferably substantially within a range of 0,006 inches to 0.01 inches. Nipple member 18 includes a nursing portion 24, which is fabricated from a first material, and a mounting flange portion 26 that is fabricated from a second material. The nursing portion 24 and the mounting flange portion 26 are co-extensive and unitary with each other. Preferably, the first material of which nursing portion 24 is fabricated is substantially transparent so that a caregiver can readily ascertain that nursing portion 24 is clean before feeding an infant, and determine whether an infant is drawing water or air during feeding. Nursing portion 24 is also preferably clear, meaning that it is not tinted, although, a tinted embodiment is within the purview of the invention.

According to one important aspect of the invention, the second material of which mounting flange portion 26 is fabricated is preferably color-coded to indicate to a caregiver that nipple number 18 is of a certain type. In the illustrated embodiment, mounting flange portion 26 is color-coded white, which would indicate to a caregiver that nipple member 18 is a slow type nipple member for newborn infants to infants that are about 3 months old. A groove 28 is defined in mounting flange portion 26, as is known in the field, to permit air into a baby bottle 12 during feeding in order to replace the milk or other beverage that is consumed by the infant. The color coding may be accomplished by molding the mounting flange portion 26 out of a colored opaque material, or out of a tinted translucent or transparent material.

According to another advantageous aspect of the invention, a code collar 30 is also fabricated from the second, color-coded material and extends upwardly as a collar between the mounting flange portion 26 and the nursing portion 24. Code collar 30 is dimensioned so as to be visible by a caregiver when the nipple 18 is assembled onto the infant nursing system 10 as shown in FIG. 1. Accordingly, code collar 30 permits a caregiver to determine the flow rate capacity of the nipple member 18 at any point in time during use.

Another important aspect of the invention is that the second material of which mounting flange portion 28 and code collar 30 is fabricated is preferably harder than the first material of which nursing portion 24 is fabricated. As a result, the nipple member 18 is much harder for an infant to pull from the nursing system 10 during use. In addition, the nursing portion may be made softer and more comfortable for an infant. Preferably, the first material of which nipple portion 24 is fabricated has a Durometer A hardness that is substantially within the range of 20–60. More preferably, the first material as a Durometer A hardness that is within the range 40–45. The second material of which mounting flange 26 and code collar 30 is fabricated preferably has a Durometer A hardness that is within the range of 20–80. More preferably, the second material has a Durometer A hardness that is substantially within the range of 40–70. Preferably, the first and second materials are different grades of silicon, but they could alternatively be other materials that can be made transparent and clear, such as flexible vinyl or thermoplastic elastomers (TPE's).

Referring again to FIG. 2, kit 20 further includes an intermediate flow nipple member 32 that has a mounting flange portion 34 which is color coded differently than mounting flange portion 26, in this case red. A groove 36 is formed in mounting flange portion 34. Nipple number 32 further includes a nursing portion 38 that is identical to nursing portion 24, except for the design flow rate, and a code collar 40. The nursing portion 38 is preferably given a design flow rate that is appropriate for infants between 3 months and 6 months of age, and is formed from the first material discussed above. To achieve the desired flow rate, an orifice having a diameter that is substantially within the range of 0.013 inches to 0,016 inches is defined in nursing portion 38. Mounting flange portion 34 and code collar 40 are fabricated from the second material discussed above.

Kit 20 further includes a high speed nipple member 42 that is given a design flow rate for infants and small children who are 6 months and older. To achieve the desired flow rate, an orifice having a diameter that is substantially within the range of 0,018 inches to 0,021 inches is defined in a nursing portion 44. Nursing portion 44 is fabricated from the first material discussed above, and a mounting flange portion 46 having a groove 48, that is fabricated from the second material discussed above. A code collar 50 is also fabricated from the second material. Code collar 50 and mounting flange portion 46 are, in this case, color-coded red to indicate to a caregiver that nipple member 42 is of the high speed type.

Kit 20 further includes a juice-type nipple member 52 that has a mounting flange portion 54 fabricated from the second material discussed above, a groove 56 defined in the mounting flange portion 54, and a nursing portion 58 that has a cross-cut defined therein for juices and other pulpy liquids to pass there through. A code collar 60 is also formed of the second material, and both the code collar 60 and mounting flange portion 54 are color-coded, in this case orange.

Optionally, kit 20 could include a fifth member that is styled as a "transition nipple," intended to help wean an infant to drink out of a cup. The "transition nipple" might be color coded, for example, green.

It is to be understood that the color codings discussed herein are exemplary only, and that the invention is not limited to a specific color-coding scheme. Moreover, it is to be understood that the color-coding discussed herein could be applied to only a portion of the mounting flange portion of a respective nipple member, and not to the entire mounting flange portion.

Figure 3:
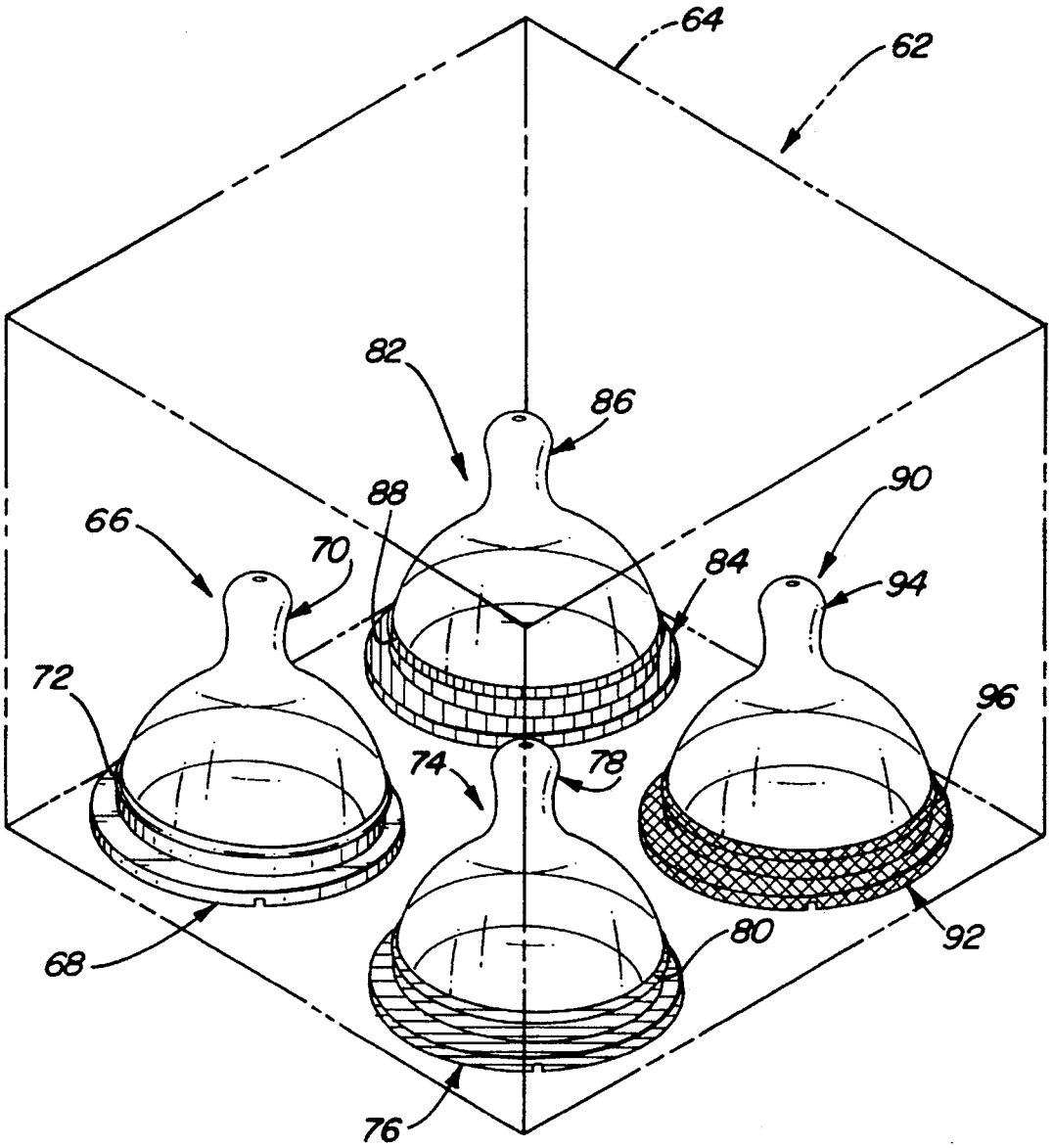
FIG. 3 is a diagrammatical view of a kit that is constructed according to a second embodiment of the invention, with several exemplary nipples illustrated therein, also in perspective view.

Referring now to FIG. 3, a kit 62 that is constructed according to a second embodiment includes a package 64, and a number of nipple members 66, 74, 82, 90 of the type that are intended to be used with a collapsible bag type infant feeding system. Other than the type of nursing system they are designed for, nipple members 66, 74, 82 and 90 are identical in the color-coding, flow rates and materials used to the nipple members 18, 32, 42 and 52 that are discussed above in reference to the embodiment depicted in FIG. 2. More specifically, nipple member 66 includes a mounting flange portion 68, a nipple portion 70 and a code collar 72 that is identical in material, color-coding and design flow rate to the mounting flange 26, nursing portion 24 and code-collar 30 in the nipple member 18 discussed above. This means that the mounting flange 68 and code color 72 are fabricated from the second material, and are color-coded red. The nipple portion 70 has a design flow rate that is intended for infants who are of 0–3 months of age. Similarly, intermediate nipple member 74 includes a mounting flange portion 76, a nipple portion 78 and a code-collar portion 80 that are identical, except in shape, to the nipple member 32 discussed above. Nipple member 82 includes a nipple portion 86, a mounting flange portion 84 and a code collar 88 that are identical, except in shape, to those in the nipple member 42 discussed above. Juice-type nipple member 90 includes a mounting flange portion 92, a nipple portion 94 and a code collar 96 that are identical, except in shape, to those components of the nipple member 52 discussed above.

Figure 4:
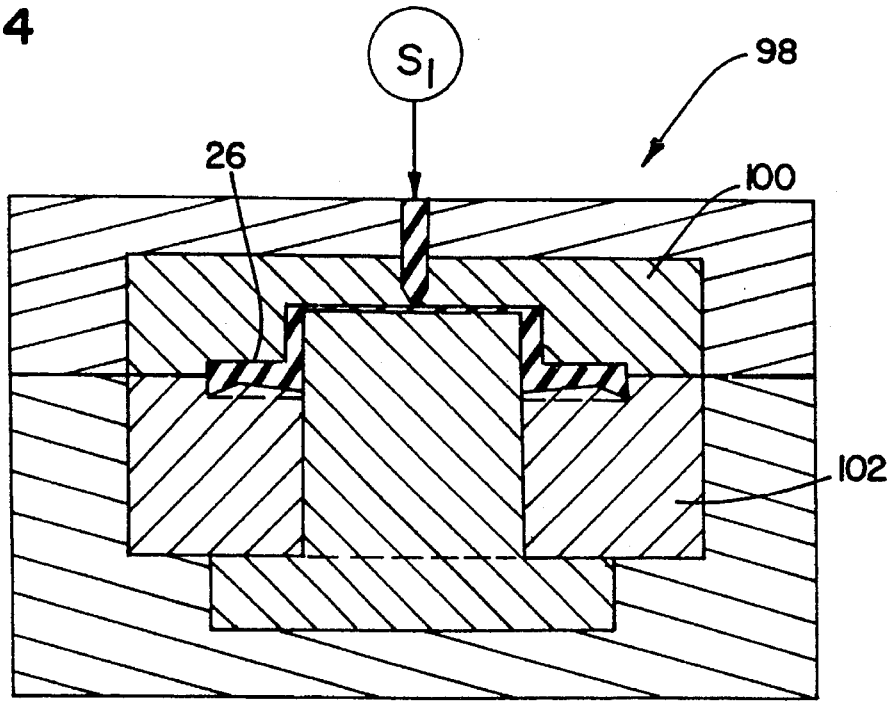
FIG. 4 is a cross-sectional view of a molding assembly that depicts a first step of a method for fabricating a nipple member according to a preferred embodiment of the invention.

FIG. 4 depicts a molding assembly 98 that is used, according to a preferred embodiment of the invention, to form the mounting flange portion 26 and the code collar 30 of a nipple member such as the nipple member 18 that is depicted in FIGS. 1 and 2. Molding assembly 98 is preferably a compression transfer type mold, well known in the industry, and is coupled to a source $S_1$ of the second material referred to above. Cavity inserts 100, 102 in the molding assembly 98 are configured so as to define a space that corresponds in shape to the desired shape of the mounting flange portion 26 and code collar 30. After the second material is injected into the molding assembly 98, the material is compressed and heated using known techniques to form the mounting flange portion 26 and code collar portion 30.

Figure 5:
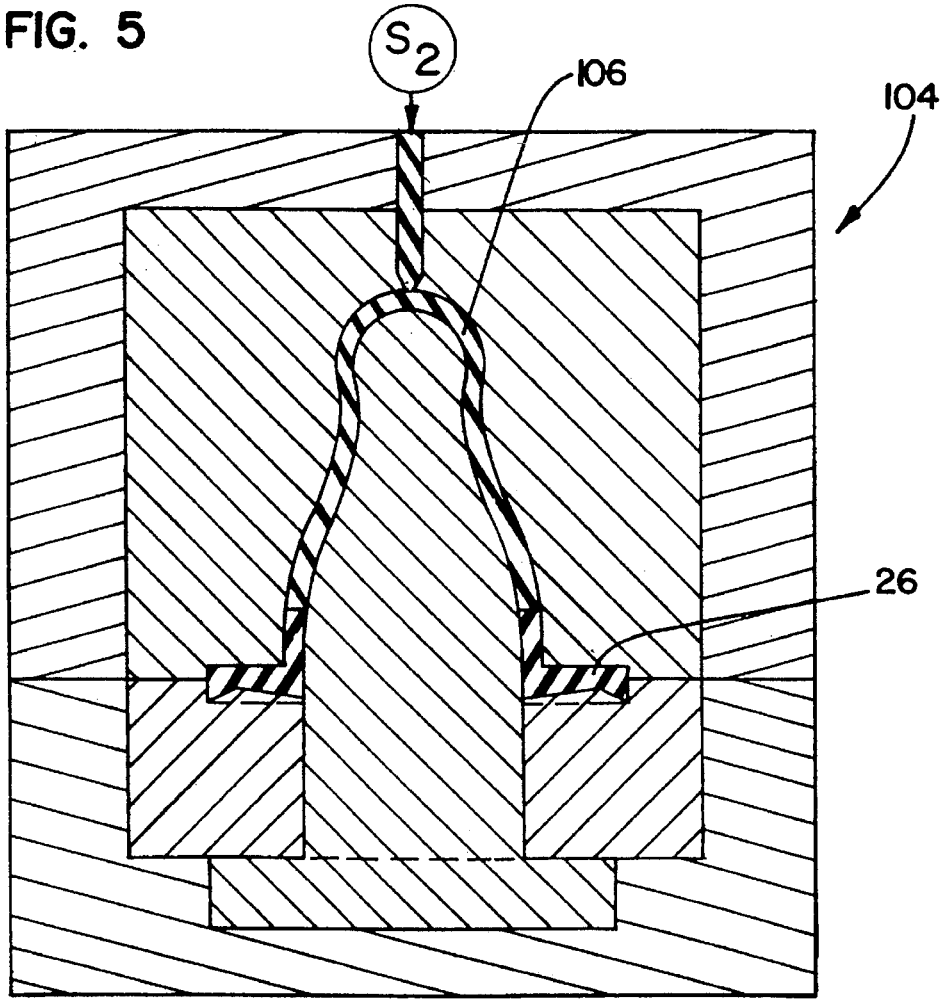
FIG. 5 is a cross-sectional view of a second molding assembly that depicts a second step of the method that is first depicted in FIG. 4.

FIG. 5 depicts a second molding assembly 104, in which the formed mounting flange portion 26 and code collar portion 30 are inserted for a second step in the preferred molding process. In this step, the first material referred to above is injected from a source $S_2$ into a nursing portion mold area 106 that is shaped to the desired configuration of the nursing portion of the final nipple member. Nursing portion mold area is contiguous with the formed mounting flange portion 26 and code collar portion 30, as may be seen in FIG. 5. In this process, the first and second materials are selected for compatibility so as to bond together as the first material is injected into the mold area 106. For example, the first material may be liquid silicone, while the second material is silicone rubber of the type that is available from General Electric Company as Series 93005.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A nipple member for an infant nursing system, comprising:

a means for mounting said nipple member to a bottle, said means for mounting comprising a mounting flange portion, said mounting flange portion being immutably nontransparent; and a nursing portion, said nursing portion being substantially clear and transparent, whereby a caregiver can readily ascertain that said nursing portion is clean before feeding an infant.

2. A nipple member according to claim 1, wherein said mounting flange portion is translucent, but not transparent.

3. A nipple member according to claim 1, wherein said mounting flange portion is opaque.

4. A nipple member according to claim 1, wherein said mounting flange portion is color coded to indicate a type of said nipple member to a caregiver.

5. A nipple member according to claim 4, wherein said color coding is representative of a design flow rate for said nursing portion.

6. A nipple member according to claim 5, wherein said color coding is representative of a type of beverage that said nursing portion is designed for.

7. A nipple member according to claim 4, further comprising a code collar portion, coextensive with said nursing portion, that is positioned so as to be visible to a caregiver during feeding, said code collar portion also having said color coding provided thereon.

8. A nipple member according to claim 1, wherein said mounting flange portion is fabricated from a different material than said nursing portion.

9. A nipple member according to claim 1, wherein said mounting flange portion has a higher durometer hardness than said nursing portion.

10. A nipple member for an infant nursing system, comprising:

a means for mounting said nipple member to a bottle, said means form mounting comprising a mounting flange portion, said mounting flange portion having at least an area thereon that is immutably color coded to indicate a type of said nipple member; and a nursing portion, said nursing portion being substantially transparent, whereby a caregiver can readily ascertain that said nursing portion is clean before feeding an infant.

11. A nipple member according to claim 10, further comprising a cede collar portion, coextensive with said nursing portion, that is positioned so as to be visible to a caregiver during feeding, said code collar portion also having said color coding provided thereon.

12. A nipple member according to claim 10, wherein said color coding is representative of a design flow rate for said nursing portion.

13. A nipple member according to claim 10, wherein said color coding is representative of a type of beverage that said nursing portion is designed for.

14. A nipple member for an infant nursing system, comprising:

a nursing portion, said nursing portion comprising a first material; and a means for mounting said nipple member to a bottle, said means for mounting comprising a mounting flange portion, unitary with said nursing portion, said mounting flange portion comprising a second material that is harder than said first material, whereby said nipple member is more difficult to pull out from a nursing system during nursing than was heretofore possible.

15. A nipple member according to claim 14, wherein said first material has a Durometer A hardness that is substantially within the range of 20–60.

16. A nipple member according to claim 15, wherein said first material has a Durometer A hardness that is substantially within the range of 40–45.

17. A nipple member according to claim 16, wherein said second material has a Durometer A hardness that is substantially within the range of 20–80.

18. A nipple member according to claim 17, wherein said second material has a Durometer A hardness that is substantially within the range of 40–70.

19. A nipple member according to claim 14, wherein both said first and second materials comprise silicone.

20. A method of making an improved nipple member for an infant nursing system, comprising steps of:

(a) molding a mounting flange portion not having a threaded depending flange from a first material that is immutable colored; and (b) molding a nursing portion unitarily with said mounting flange portion out of a second material that is substantially clear and transparent, whereby a color-coded nipple member is produced that has a clean-appearing nursing portion.

21. A method of making an improved nipple member for an infant nursing system, comprising steps of:

(a) molding a nursing portion out of a first material; and (b) molding a mounting flange portion not having a threaded depending flange unitarily with said nursing portion out of a second material that is harder than said first material, whereby a nipple member is formed that is more difficult to pull out of a nursing system during use than nipple members heretofore known.

22. A nipple member for an infant nursing system, comprising:

a means for mounting said nipple member to a bottle, said means for mounting comprising a mounting flange portion, said mounting flange portion being tinted a specific color that is indicative of a type of said nipple member; and a nursing portion, said nursing portion being substantially clear and transparent, whereby a caregiver can readily ascertain that said nursing portion is clean before feeding an infant.

* * * * *